US009310148B2

(12) United States Patent
Brown

(10) Patent No.: US 9,310,148 B2
(45) Date of Patent: Apr. 12, 2016

(54) APPARATUS AND METHOD REQUIRING DISASSEMBLY OF RIFLE TO REMOVE MAGAZINE

(71) Applicant: Daniel James Brown, Knoxville, TN (US)

(72) Inventor: Daniel James Brown, Knoxville, TN (US)

(73) Assignee: Tomas Quis, Knoxville, TN (US)

( * ) Notice: Subject to any disclaimer, the term of this patent is extended or adjusted under 35 U.S.C. 154(b) by 0 days.

(21) Appl. No.: 14/724,852

(22) Filed: May 29, 2015

(65) Prior Publication Data

US 2015/0345885 A1 Dec. 3, 2015

Related U.S. Application Data

(60) Provisional application No. 62/004,668, filed on May 29, 2014.

(51) Int. Cl.

| | |
|---|---|
| ***F41A 17/38*** | (2006.01) |
| ***F41A 3/66*** | (2006.01) |
| ***F41A 9/64*** | (2006.01) |

(52) U.S. Cl.

CPC . *F41A 17/38* (2013.01); *F41A 3/66* (2013.01); *F41A 9/64* (2013.01); *Y10T 29/49961* (2015.01)

(58) Field of Classification Search

CPC ..... F41A 17/38

See application file for complete search history.

(56) References Cited

U.S. PATENT DOCUMENTS

| | | | | |
|---|---|---|---|---|
| 1,866,722 | A * | 7/1932 | Pedersen | F41A 9/41 42/18 |
| 7,941,958 | B1 | 5/2011 | Zedrosser | |
| 8,069,606 | B1 | 12/2011 | Saur | |
| 8,453,367 | B2 | 6/2013 | Overstreet et al. | |
| 8,661,963 | B2 | 3/2014 | Patel | |
| 8,984,794 | B1 | 3/2015 | Saur | |
| 9,010,004 | B1 * | 4/2015 | Fu | F41A 17/38 42/49.01 |
| 2006/0168870 | A1 | 8/2006 | Haponski et al. | |
| 2009/0249672 | A1 * | 10/2009 | Zedrosser | F41A 17/36 42/6 |
| 2010/0281737 | A1 | 11/2010 | Cahill | |
| 2011/0010977 | A1 * | 1/2011 | Cash | F41A 9/65 42/50 |
| 2015/0068088 | A1 * | 3/2015 | Souza | F41A 17/44 42/49.02 |
| 2015/0082678 | A1 * | 3/2015 | Jacobson | F41A 9/65 42/8 |

* cited by examiner

*Primary Examiner* — Troy Chambers
*Assistant Examiner* — Adam J Zimmer
(74) *Attorney, Agent, or Firm* — Robinson IP Law, PLLC

(57) ABSTRACT

A magazine locking assembly is provided for preventing removal of a magazine from a firearm having a receiver, a magazine, and a bolt carrier assembly a without disassembly of the firearm. The locking assembly includes a magazine block assembly secured adjacent the magazine well of the firearm, a magazine safety pin for securing the magazine block assembly adjacent the magazine well of the firearm, a safety pin cover movably attached to the firearm adjacent the bolt carrier assembly for concealing the safety pin head of the magazine safety pin, and a cover detent pin configured to engage the safety pin cover passageway to prevent the safety pin cover from moving. When the magazine locking assembly and firearm are in an assembled configuration the safety pin cover conceals the safety pin head of the magazine safety pin and the bolt carrier assembly conceals the cover detent pin.

9 Claims, 23 Drawing Sheets

PRIOR ART

APPARATUS AND METHOD REQUIRING DISASSEMBLY OF RIFLE TO REMOVE MAGAZINE

CROSS-REFERENCE TO RELATED APPLICATION

This application claims priority to now U.S. Application Ser. No. 62/004,668 to Daniel James Brown entitled "Apparatus and Method Requiring Disassembly of Rifle to Remove Magazine" which was filed on May 29, 2014, the contents of which are incorporated herein by reference in its entirety.

FIELD

This disclosure relates to the field of firearms. More particularly, this disclosure relates to modifications for firearms and methods therefor.

BACKGROUND

Firearm technology is constantly evolving to provide safer, more efficient, and/or more reliable firearms. The Sa vzor 58 rifle was developed in Czechoslovakia between 1956 and 1958 and soon became the standard firearm in that country during its years as a Soviet controlled country. Various versions of the Sa vzor 58 have become very popular with gun collectors, sportsmen, and the like, and a demand has developed for these rifles. However, certain laws (federal and state) prohibit the importation, sell, and/or use of such weapons in the United States unless certain modifications are made to the weapons.

California is particularly well known for its strict gun laws including, for example, California Penal Code section 12276.1(a)(1) regarding detachable magazines and the requirement that certain weapons not be equipped with detachable magazines. One way to comply with this legal provision is by the use of a "bullet button" which requires an external object (e.g., a bullet or tool) to depress a button so that a magazine can be released from a magazine well on a weapon. However, laws are subject to change, and there has been a growing trend to further limit the dissemination of firearms. Thus, in the years to come, a "bullet button" device may not be enough for law abiding weapons enthusiasts to import, own, or otherwise use a rifle such as a modified Sa vzor 58.

More recently, the State of Connecticut has enacted gun control legislation defining an "assault weapon" as a "semi-automatic, centerfire rifle that has an ability to accept a detachable magazine" wherein a "detachable magazine" is defined as "an ammunition feeding device that can be removed without disassembling the firearm action". See section 53-202a of the Connecticut General Statutes.

The Sa vzor 58, for example, is configured such that, even if employing a magazine block for mechanically preventing a magazine from being disengaged from a rifle unless a receiver cover is removed, such a magazine could still be removed mechanically (and therefore categorized as a "detachable magazine") by manipulation of a safety pin without necessarily removing the rifle's bolt carrier assembly (i.e., the "firearm action"). The same problem exists with respect to vzor 58 pistols. Therefore, under certain state laws such as those of Connecticut, an Sa vzor 58 rifle (or pistol version) would still be technically defined as an assault weapon despite the use of a magazine block apparatus such as, for example, described in U.S. Pat. No. 8,191,298 entitled "Magazine Quick-Release Blocking Apparatus and Method".

What is needed, therefore, is an apparatus and method for modifying a firearm such as a Sa vzor 58 rifle or pistol such that the firearm magazine cannot be detached from the rifle without necessarily disassembling the rifle firing action.

SUMMARY

The above and other needs are met by a magazine locking assembly configured to prevent removal of a magazine from a firearm. In one aspect, the magazine locking assembly is configured to prevent removal of a magazine from a firearm having a receiver, a magazine secured within a magazine well of the receiver, and a bolt carrier assembly. The magazine locking assembly includes a magazine block assembly secured adjacent the magazine well of the firearm, a magazine safety pin including a safety pin head for securing the magazine block assembly adjacent the magazine well of the firearm, a safety pin cover including a safety pin cover passageway formed therethrough movably attached to the firearm adjacent the bolt carrier assembly for concealing the safety pin head of the magazine safety pin, and a cover detent pin configured to engage the safety pin cover passageway to prevent the safety pin cover from moving. The magazine block prevents the magazine from being removed from the firearm without removal of the magazine block assembly, and when the magazine locking assembly and firearm are in an assembled configuration the safety pin cover conceals the safety pin head of the magazine safety pin and the bolt carrier assembly conceals the cover detent pin.

In one embodiment, the safety pin cover is slidably attached to the receiver of the firearm within a safety pin cover groove formed in the receiver. In another embodiment, the cover detent pin is housed within a detent pin channel formed in the receiver of the firearm.

In yet another embodiment, the magazine locking apparatus further includes a detent pin actuator located in the detent pin channel for urging the detent pin out from the detent pin channel. In one embodiment, the detent pin actuator is formed of a spring.

In another embodiment, the magazine block assembly is formed of a magazine block secured to the receiver with a magazine catch pin.

In one embodiment, the firearm is a Sa vzor 58 rifle.

In another aspect, a magazine locking assembly is provided to prevent removal of a magazine from a firearm having a receiver, a magazine secured within a magazine well of the firearm, and a bolt carrier assembly. The locking assembly includes a magazine block assembly secured adjacent the magazine well of the firearm, a magazine safety pin including a safety pin head for securing the magazine block assembly adjacent the magazine well of the firearm, a safety pin cover including a safety pin cover passageway formed therethrough movably attached to the firearm adjacent the bolt carrier assembly for concealing the safety pin head of the magazine safety pin, a cover detent pin configured to engage the safety pin cover passageway to prevent the safety pin cover from moving housed within a detent pin channel formed in the receiver, and a detent pin actuator located in the detent pin channel for urging the detent pin out from the detent pin channel and into contact with the safety pin cover. The magazine block prevents the magazine from being removed from the firearm without removal of the magazine block assembly, and when the magazine locking assembly and firearm are in an assembled configuration the safety pin cover conceals the safety pin head of the magazine safety pin and the bolt carrier assembly conceals the cover detent pin.

In yet another aspect, a method of securing a magazine of a firearm is provided such that the magazine may not be removed without substantial disassembly of the firearm. The method includes the steps of: providing a firearm having a receiver, a magazine secured within a magazine well of the receiver, and a bolt carrier assembly; securing a magazine block assembly to the receiver adjacent the magazine well of the firearm to prevent the magazine from being removed without removal of the magazine block assembly; securing the magazine block assembly to the receiver with a magazine safety pin having a safety pin head inserted into the receiver; slidably attaching a safety pin cover to the receiver adjacent the bolt carrier assembly of the firearm such that the safety pin cover substantially conceals the safety pin head of the magazine safety pin; and securing the safety pin cover in position with a movable detent pin.

BRIEF DESCRIPTION OF THE DRAWINGS

Further features, aspects, and advantages of the present disclosure will become better understood by reference to the following detailed description, appended claims, and accompanying figures, wherein elements are not to scale so as to more clearly show the details, wherein like reference numbers indicate like elements throughout the several views, and wherein:

DETAILED DESCRIPTION

Various terms used herein are intended to have particular meanings Some of these terms are defined below for the purpose of clarity. The definitions given below are meant to cover all forms of the words being defined (e.g., singular, plural, present tense, past tense). To the extent that any term below diverges from the commonly understood and/or dictionary definition of such term, the definitions below control.

Clipped Position: the position of a magazine relative to a firearm such that the magazine is secured to the firearm in a manner in which a round can be fired from the magazine (if at least one round is present in the magazine).

Magazine: a device for holding one or more rounds of ammunition and, in some cases, urging one or more rounds into a firing chamber of a firearm to which the magazine is attached in a clipped position.

Magazine Block Pin (or "Catch Pin"): an elongated, preferably cylindrical, pin configured for extending through the width of a firearm along a passage to hold two or more objects together, preferably having a diameter or average cross-sectional distance ranging from about 3.8 mm to about 4.2 mm, and a length ranging from about 27 mm to about 31 mm.

Magazine Block Safety Pin (or "Safety Pin"): an elongated nail-like device preferably including a nail-like head and a bifurcated distal end defining a first leg and a second leg, wherein the second leg is preferably longer than the first leg and wherein the second leg preferably includes a ridge for holding the magazine safety pin in place after the magazine safety pin has been inserted into a magazine safety pin channel. The first leg preferably has a length ranging from about 24 mm to about 28 mm, and the second leg (including the ridge) preferably has a length ranging from about 26 mm to about 30 mm. The head preferably has a thickness of about 1 mm and a diameter or average cross-sectional length ranging from about 4 mm to about 6 mm.

Magazine Safety Pin Channel: A passage starting along a ventral surface of a firearm where a magazine safety pin may be inserted so as to come into frictional contact with a magazine catch pin (if a magazine catch pin is present) whereby the magazine catch pin is substantially held in place by the magazine safety pin.

Magazine Well: a three-dimensional space defined at least in part by the contour of a receiver and including, for example, the space where a quick release mechanism is typically located.

Passage: a substantially linear channel, preferably cylindrical in shape, extending from an aperture located along a first surface of an object to an aperture located along a second surface of an object.

Figure 3:
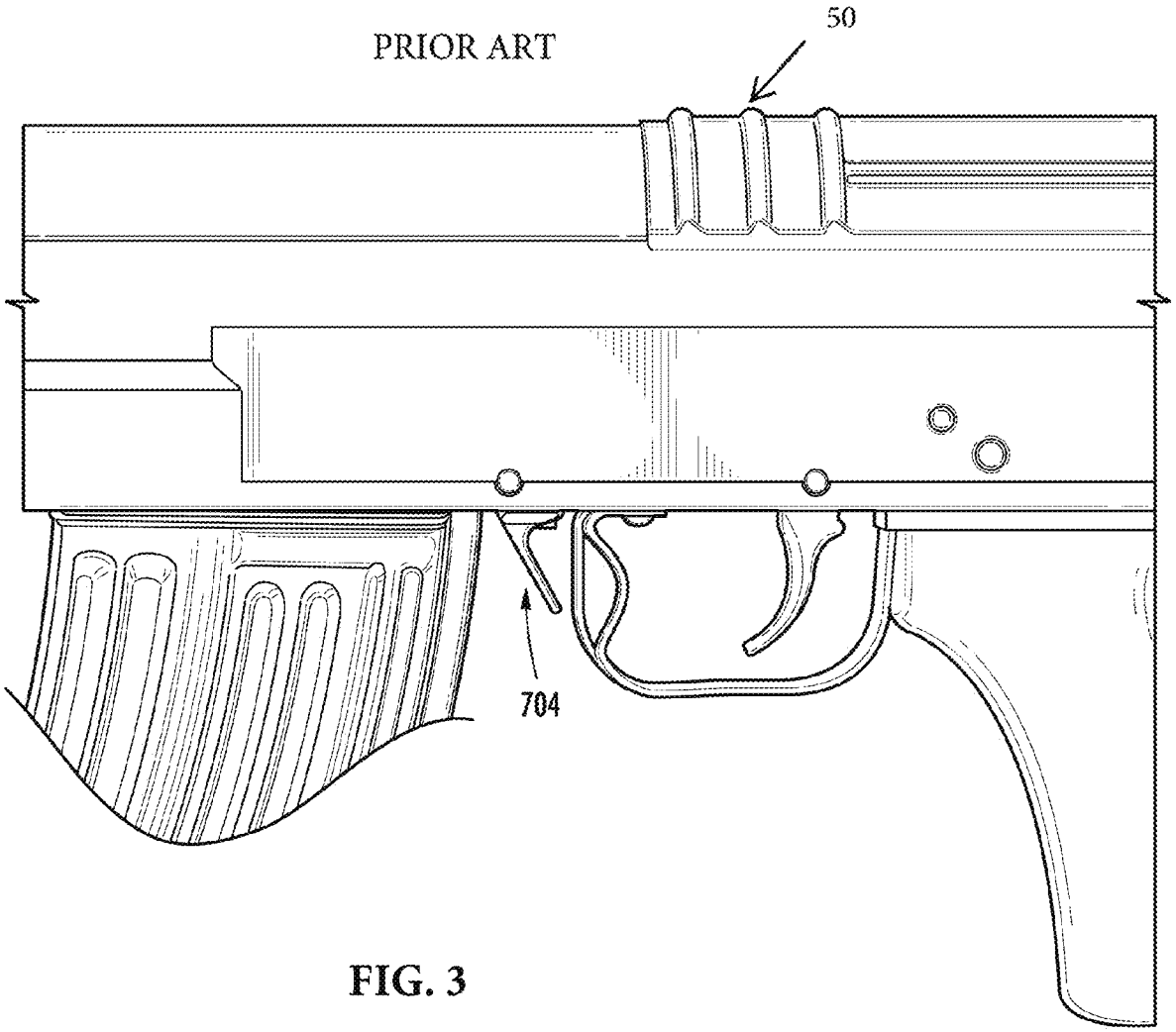
FIG. 3 shows a side view of a Sa vzor 58 rifle including a magazine quick-release actuator.

Receiver Cover: particularly with respect to a Sa vzor 58, a "receiver cover" 50 is that portion or portions of a firearm that cover the receiver as shown, for example, in FIG. 3.

Bolt Carrier Assembly: the "action" of a firearm which causes firing of a round. In the case of a Sa vzor 58, the bolt carrier assembly includes a bolt, one or more locking lugs, a striker, and a bolt carrier.

Substantially Disassembled (or Substantial Disassembly): the state of a firearm in which the receiver cover and the bolt carrier assembly have been removed from a firearm body. Based on the concept described herein, a substantially disassembled status would be a necessary condition in order to properly remove a magazine safety pin from a Sa vzor 58 firearm.

Figure 1A:
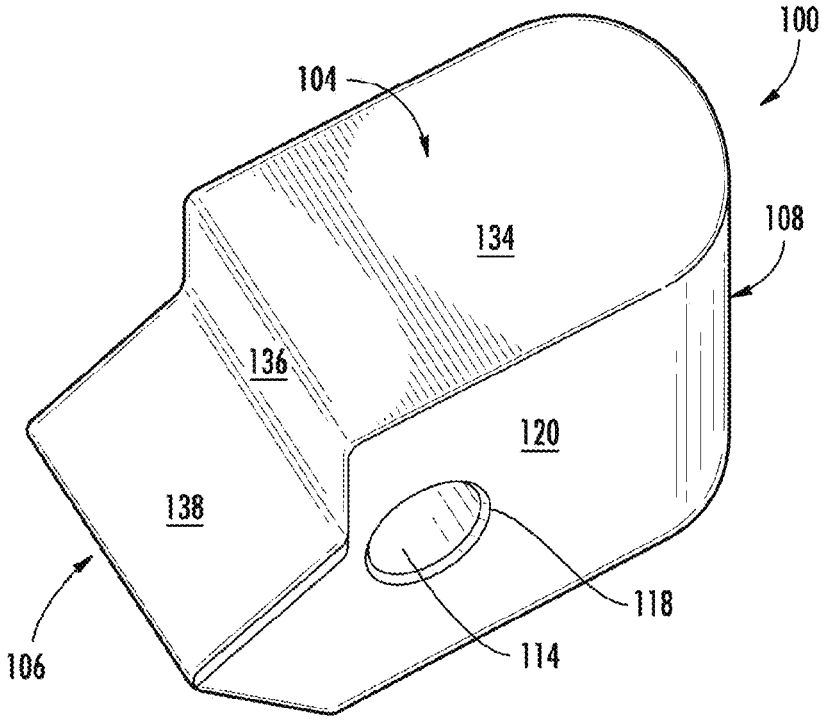
FIG. 1A shows a perspective view of a magazine block as taught in U.S. Pat. No. 8,191,298.
Figure 1B:
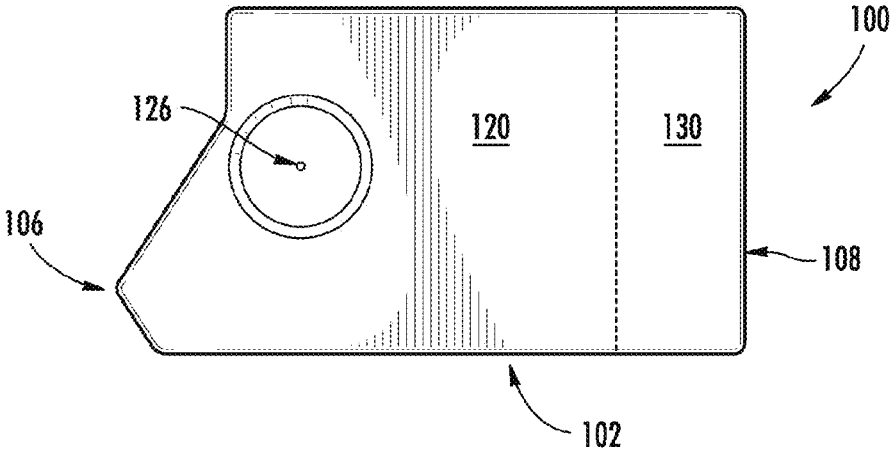
FIG. 1B shows a side view of the magazine block shown in FIG. 1A.

FIGS. 1A and 1B show a perspective view and side view of an embodiment of a magazine block 100 as taught and described in U.S. Pat. No. 8,191,298 entitled "Magazine Quick-Release Blocking Apparatus and Method," incorporated herein by reference in its entirety.

Figure 2:
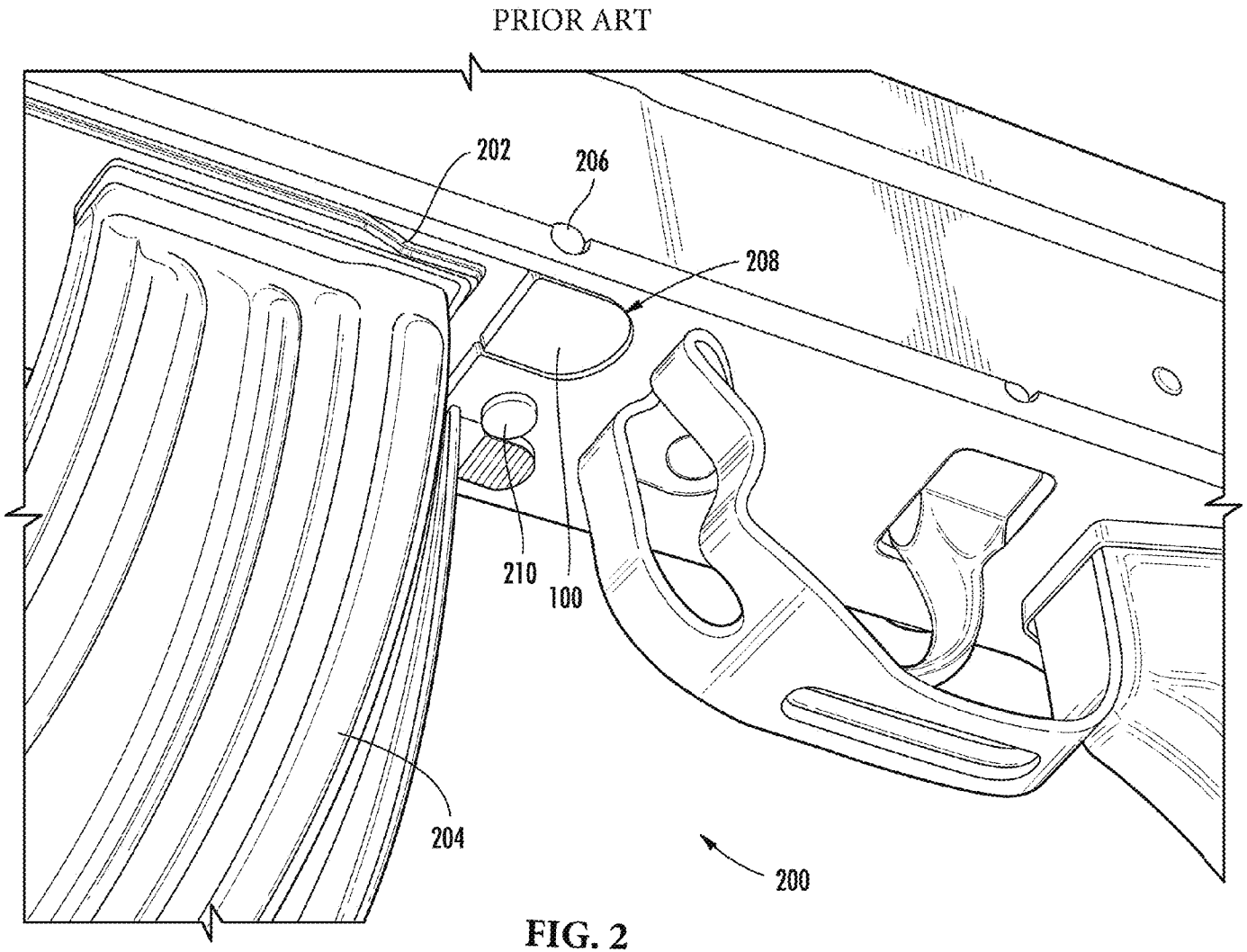
FIG. 2 shows a perspective view of a portion of a Sa vzor 58 rifle showing use of the magazine block shown in FIGS. 1A and 1B.

FIG. 2 shows a first version of a Sa vzor 58 rifle 200 including the magazine block 100 (or variation thereof). The rifle 200 also includes a magazine well 202, a magazine 204 oriented in a clipped position with the magazine well 202, and a magazine catch pin 206. The magazine block 100 and magazine catch pin 206 together may form a magazine block assembly. The magazine well 202 further includes a groove 208 where a spring-loaded magazine quick release lever 704 (shown in FIG. 3) is typically located, but where the magazine block 100 is located to prevent quick release of the magazine 204 from the rifle 200. The magazine block 100 is located in the groove 208.

Figure 4A:
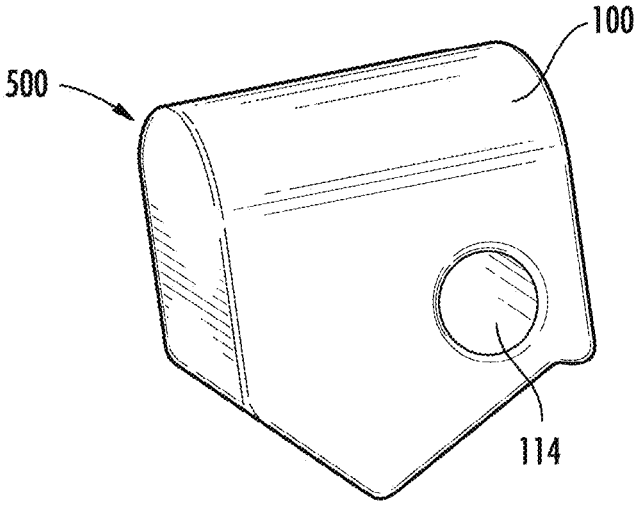
FIG. 4A shows another perspective view of the magazine block as shown in FIG. 1A and FIG. 1B.
Figure 4B:
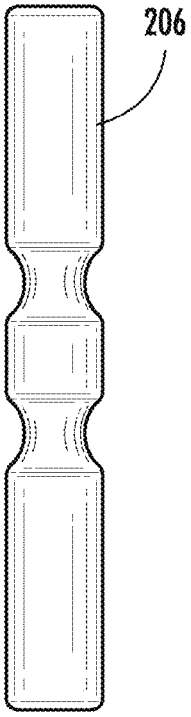
FIG. 4B shows a side view of a magazine block pin.
Figure 4C:
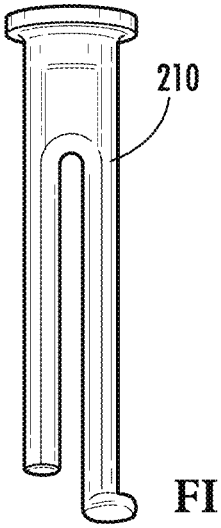
FIG. 4C shows a side view of a prior art safety pin.
Figure 5:
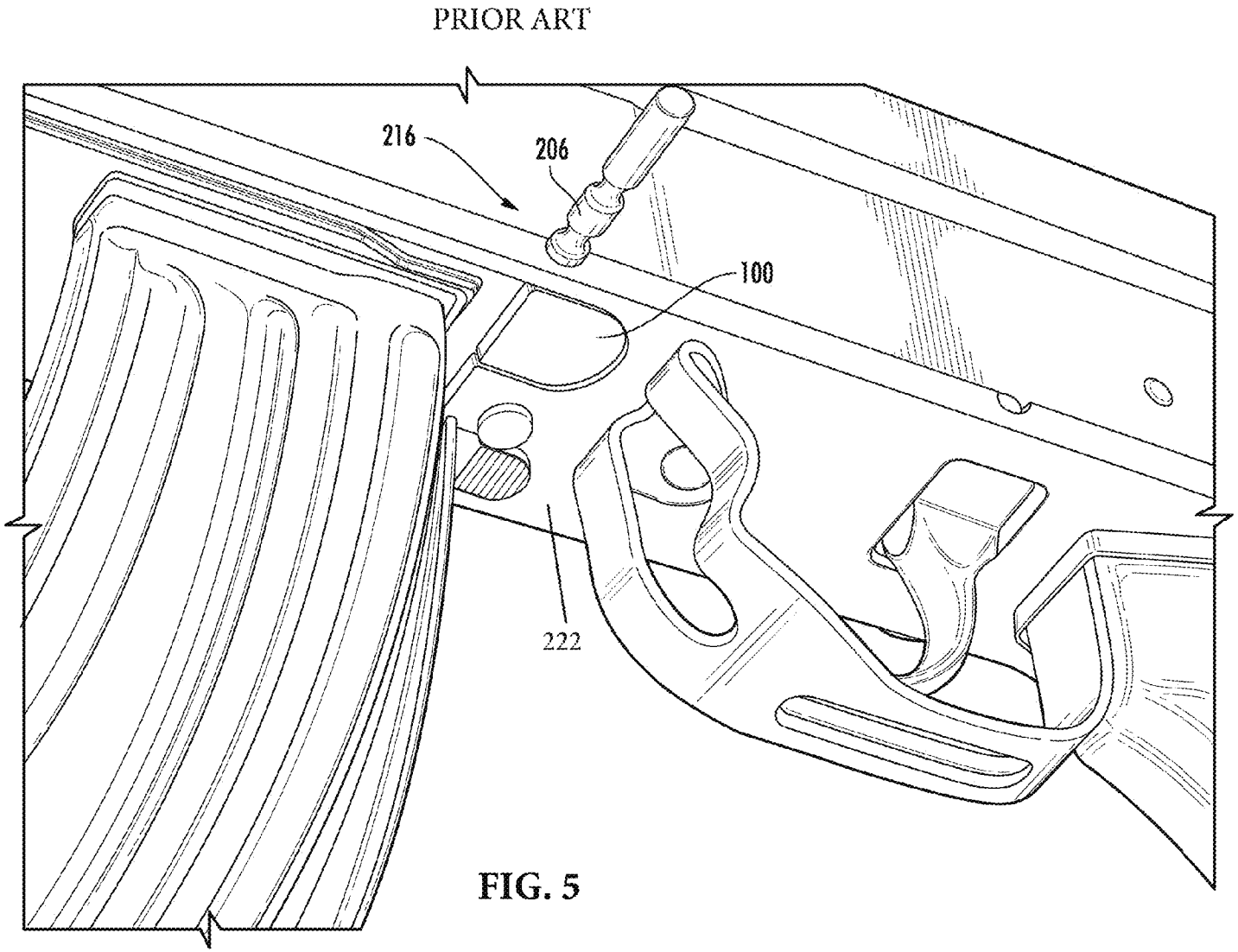
FIG. 5 shows a side view of the rifle shown in FIG. 2 and including the block pin partially removed.

The rifle 200 also preferably includes a magazine safety pin 210 which, in typical Sa vzor 58 firearms, functions (at least in part) to maintain the magazine catch pin 206 in place so that, among other things, the magazine 204 does not detach during firing of the rifle 200. The magazine block 100, the magazine catch pin 206, and the magazine safety pin 210 are shown in disassembled form in FIGS. 4A-4C. When the rifle 200 is substantially fully assembled, the magazine catch pin 206 is located through a first catch pin aperture 216, into a passage 114 of the magazine block 100, and over to a second catch pin aperture (not shown) such that the passage 114 is substantially aligned with the first catch pin aperture 216 and the second catch pin aperture. FIG. 5 shows the magazine catch pin 206 being inserted through the first catch pin aperture 216 and into the passage 114.

Figure 6:
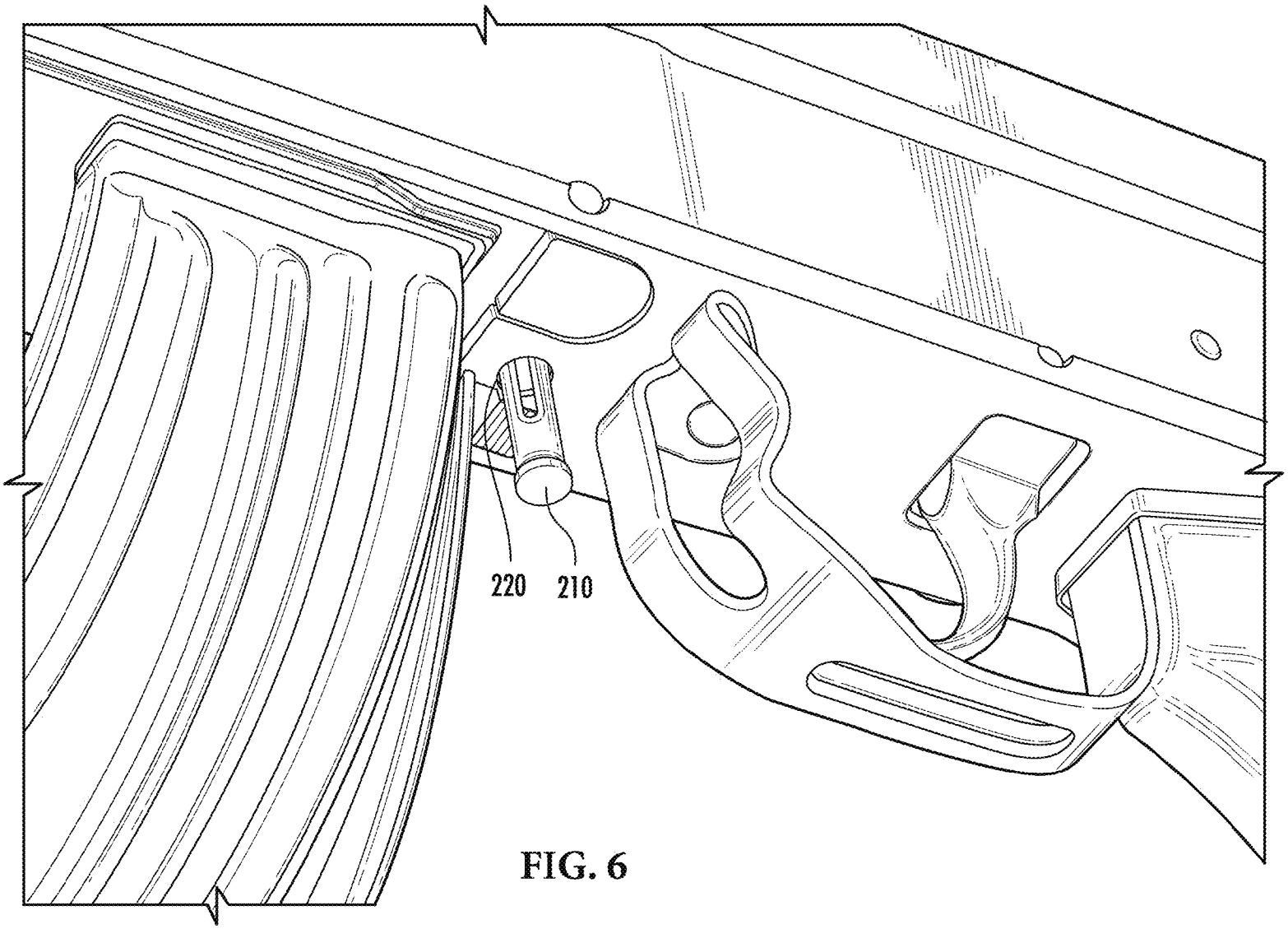
FIG. 6 shows a side view of the rifle shown in FIG. 2 and FIG. 5 and including the safety pin (shown in FIG. 4C) partially removed.

In similar fashion (but in a different spatial orientation), the magazine safety pin 210 is located at least partially in a magazine safety pin channel 220 oriented substantially orthogonal to the catch pin 206 helping to hold the catch pin 206 in a relatively stationary position, thereby ensuring that the magazine block 100 remains in place which further guarantees that the magazine 204 remains in a clipped position. FIG. 6 shows a magazine safety pin 210 being inserted into the magazine safety pin channel 220 from the outside of the rifle 200. Based on the structure and method as shown in FIG. 6, however, it is possible to circumvent certain gun laws requiring that a firearm be designed or otherwise modified such that the bolt carrier assembly must be removed to detach a magazine.

For example, in current Sa vzor 58 rifles, a person could hammer or otherwise manipulate the magazine safety pin 210 out of the magazine safety pin channel 220 from the inside of a receiver 222 while the receiver cover is removed or otherwise opened (but without removal of the bolt carrier assembly), thereby allowing someone to then disengage the magazine catch pin 206, remove a first magazine, load a new magazine, reinsert the catch pin 206, reinsert the safety pin 210 from the outside, and do so without ever causing the rifle 200 to become substantially disassembled as defined herein. Therefore, a new safety feature is required to overcome this potential circumvention problem.

Figure 7A:
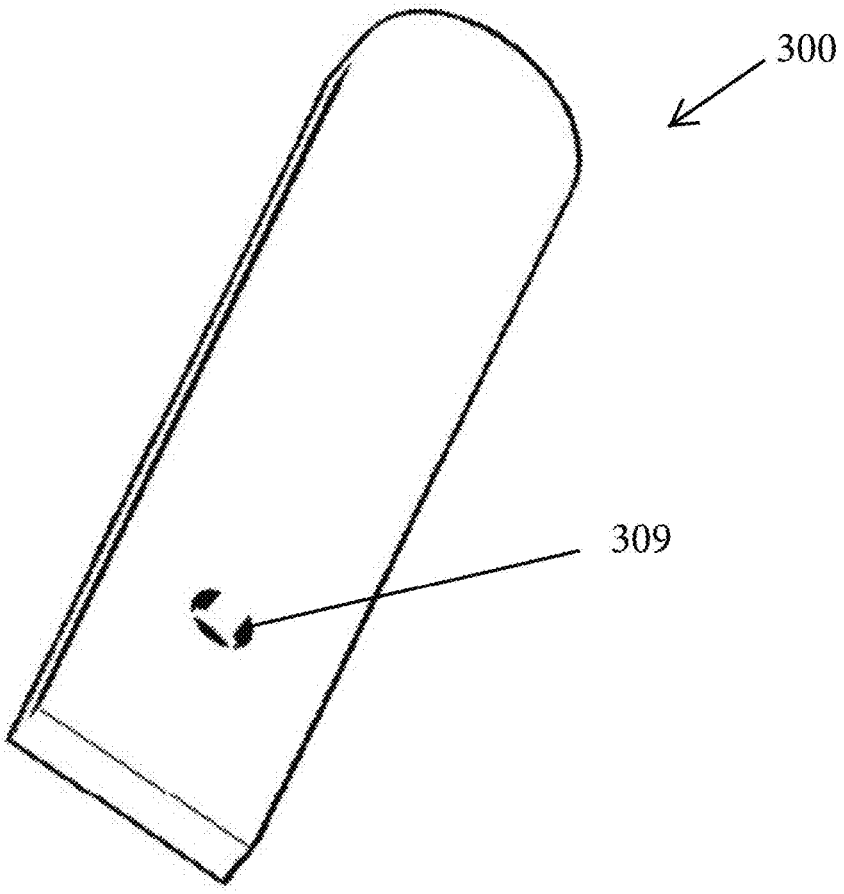
FIG. 7A shows a perspective view of a safety pin cover according to one embodiment of the disclosure.
Figure 7C:
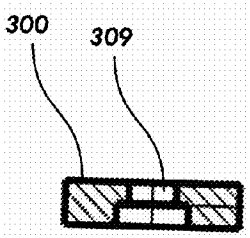
FIG. 7C shows a cross-sectional view cut across line A-A from FIG. 7B according to one embodiment of the disclosure.
Figure 7B:
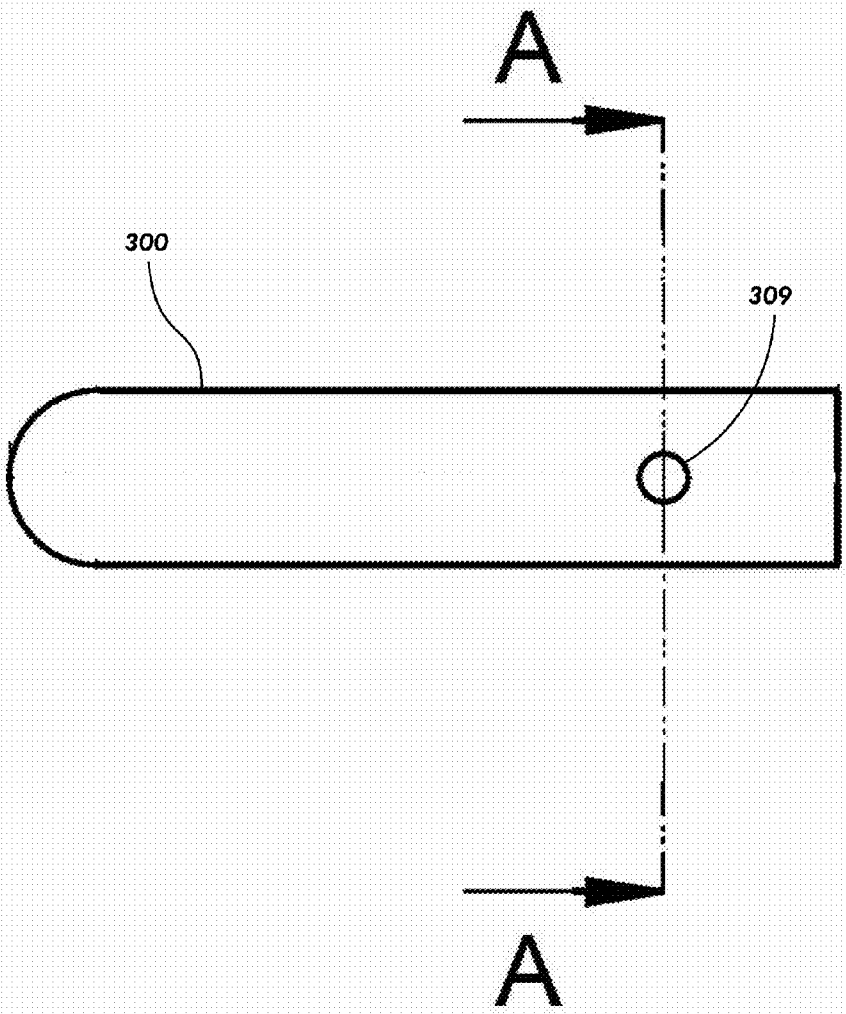
FIG. 7B shows a top plan view of a safety pin cover according to one embodiment of the disclosure.
Figure 8:
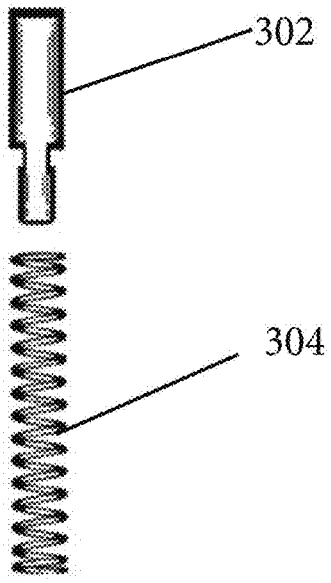
FIG. 8 shows a side view of a detent pin and a detent pin actuator according to one embodiment of the disclosure.
Figure 9:
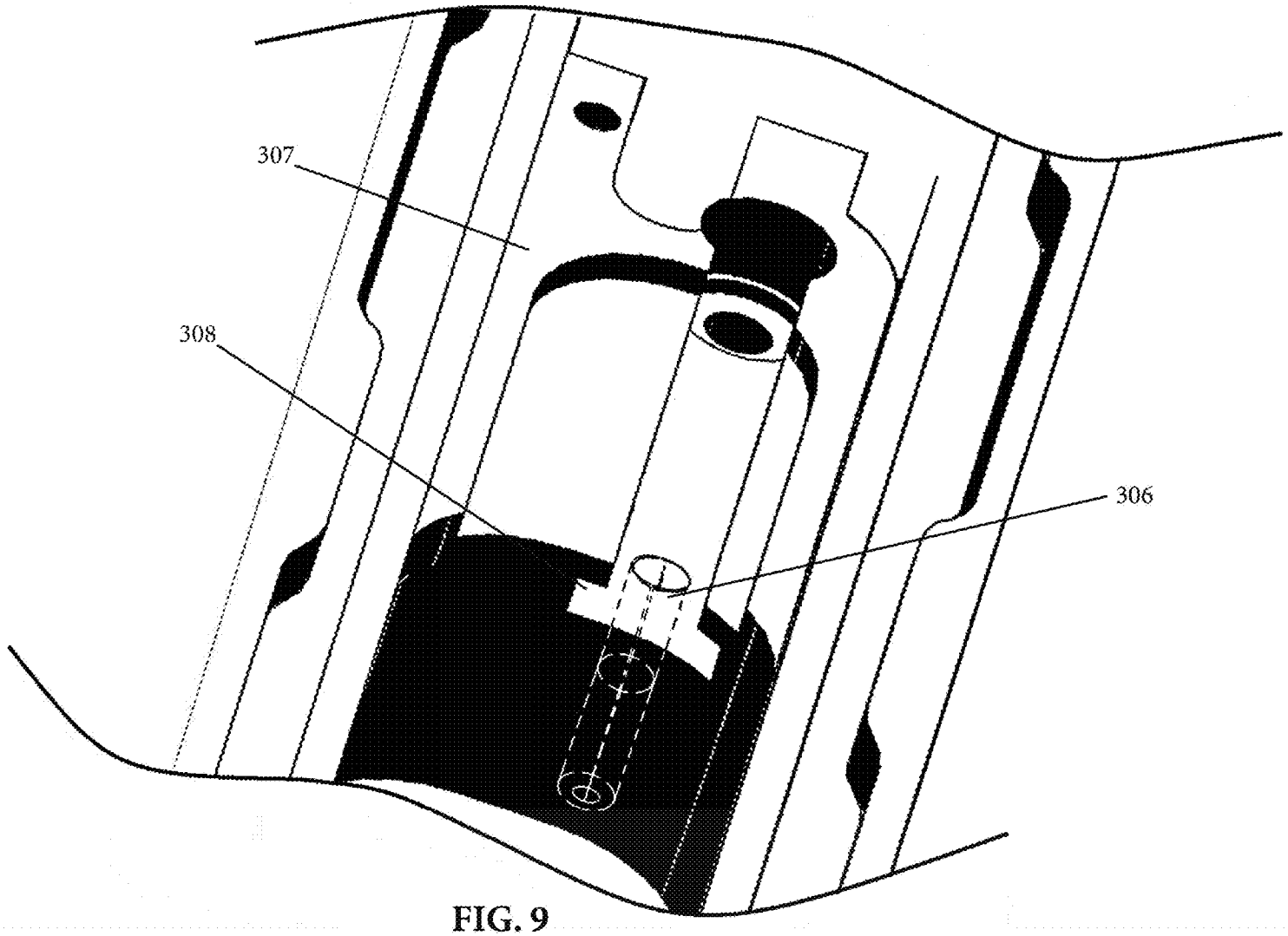
FIG. 9 shows a somewhat schematic view of a portion of a rifle including a modified receiver and a detent pin channel defined therein according to one embodiment of the disclosure.
Figure 10:
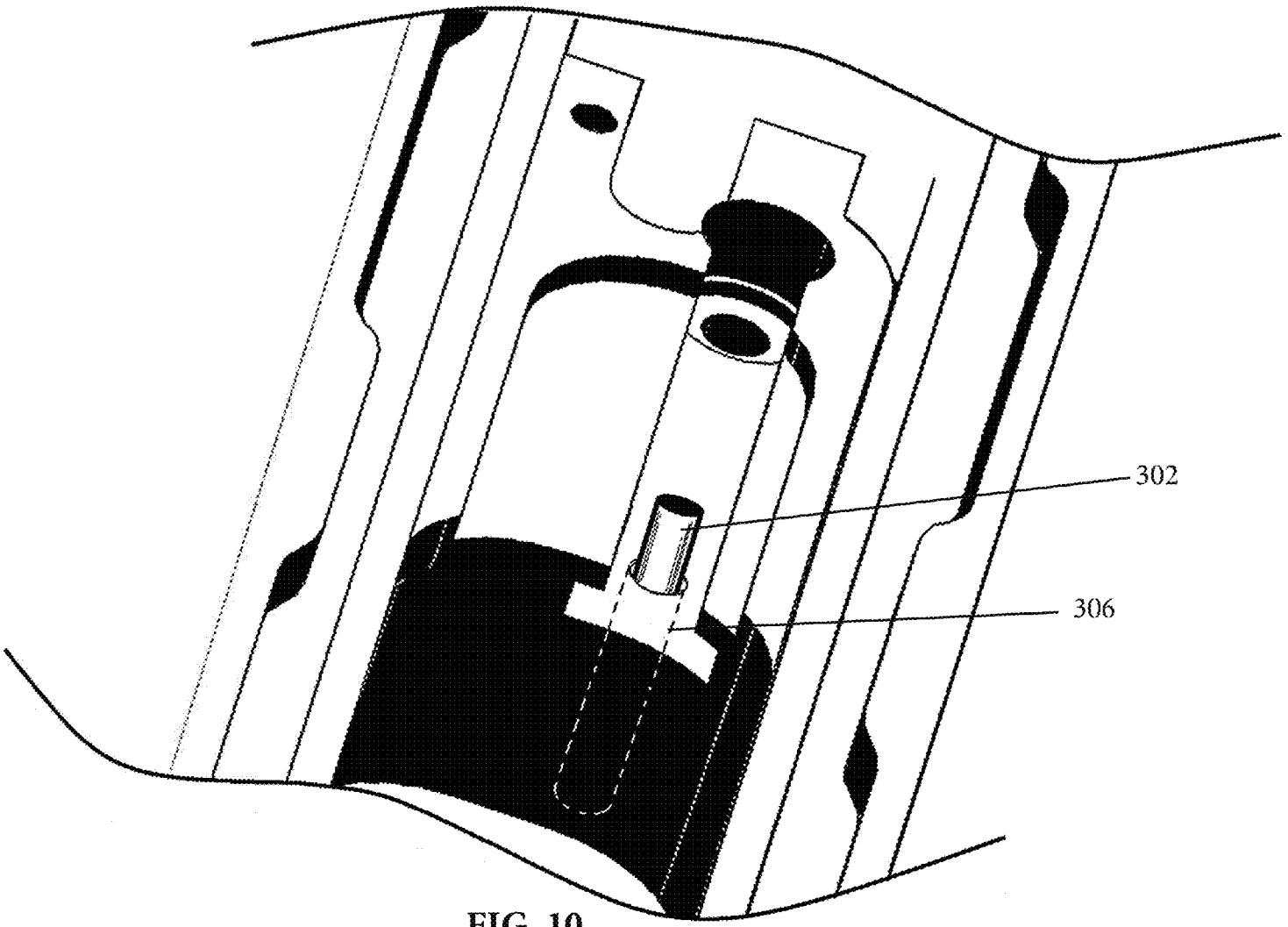
FIG. 10 shows a somewhat schematic view of a portion of a rifle including a modified receiver, a detent pin channel, and a detent pin extending from the detent pin channel according to one embodiment of the disclosure.

FIGS. 7A-7C show images of a safety pin cover 300. FIG. 8 shows a cover detent pin 302 and a cover detent pin actuator (e.g., a spring) 304. FIG. 9 shows a detent pin channel 306 for housing the detent pin 302 and the detent pin actuator 304 (wherein the detent pin actuator 304 urges the detent pin 302 out from the detent pin channel 306 against the safety pin cover 300 when such pin cover 300 is present) as shown, for example, in FIG. 10 (showing no safety pin cover 300). The detent pin channel 306 is located in a modified receiver 307. The safety pin cover 300 is slidably movable inside a safety pin cover groove 308 located in the modified receiver 307. The safety pin cover 300 is held in place by the detent pin 302 which partially extends into a safety pin cover passageway 309 (FIG. 7A).

The safety pin cover passageway 309 is shaped such that the detent pin 302 may engage the safety pin cover 300 without extending all the way through the safety pin cover 300 while still allowing the detent pin 302 to be contacted with a tool to depress the detent pin 302, as illustrated in FIG. 7C. The safety pin cover passageway 309 may have a first diameter that is substantially equal to or greater than a diameter of the detent pin 302, and a second diameter that is less than the detent pin 302 to substantially prevent the detent pin 302 from passing through the detent pin channel 306.

To slide the safety pin cover 300, a pointy object may be used to depress the detent pin 302 such that the safety pin cover 300 is free to move within the safety pin cover groove 308. While the above description contemplates the detent pin 302 being slidably engaged within the detent pin channel 306, it is also understood that the detent pin 302 may be formed of other configurations for maintaining the safety pin cover 300 in place, such as a fastener threadably engaged with the modified receiver 307.

Figure 11:
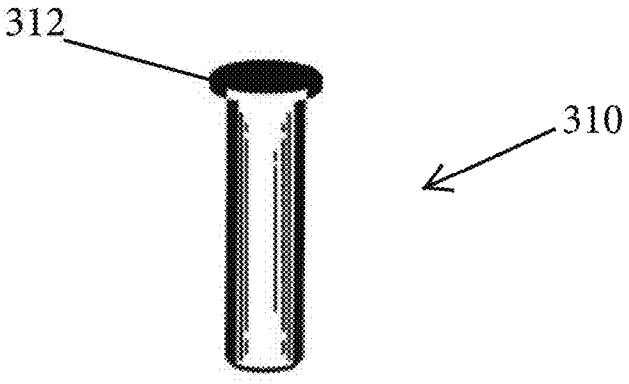
FIG. 11 shows a perspective view of a modified safety pin according to one embodiment of the disclosure.

Despite the use of the safety pin cover 300 and associated parts as described herein, the conventional safety pin 210 would still be removable from the inside out of a firearm without the need to cause the firearm to be substantially disassembled, such as by pulling the conventional safety pin 210 from an underside of the rifle. However, a modified safety pin 310 including a head 312 is shown in FIG. 11 wherein such modified safety pin 310 must be removed by forcing it out where the bolt carrier assembly is located. For example, the head 312 may have a diameter that is larger than a diameter of the safety pin channel 220 such that the head 312 may not pass through the safety pin channel 220 or otherwise pulled through the safety pin channel 220 from an underside of the rifle.

Figure 12:
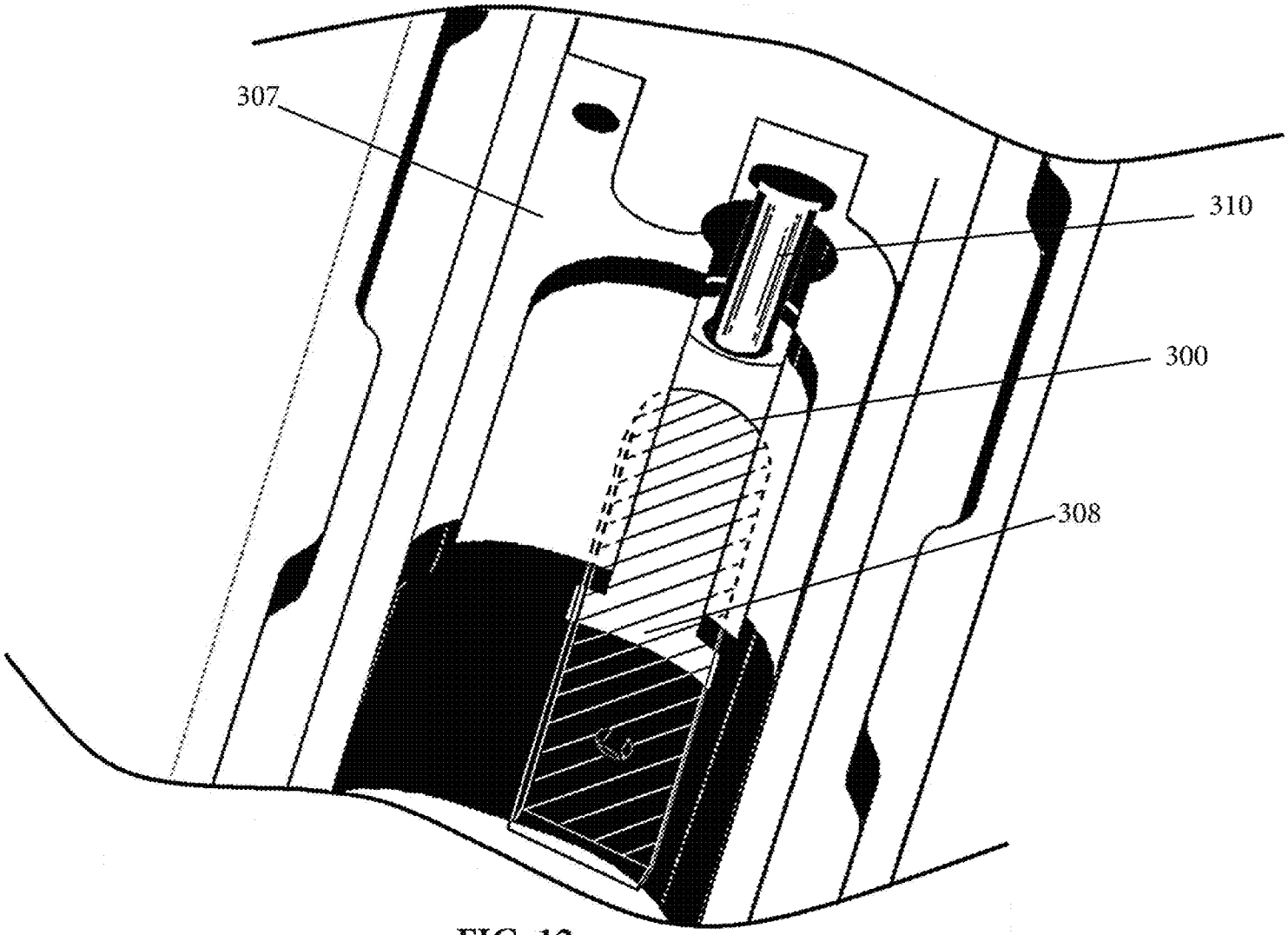
FIG. 12 shows a somewhat schematic view of a portion of a rifle including a modified receiver, a safety pin channel, a modified safety pin extending from the safety pin channel, and a phantom view of a safety pin cover partially engaged within a safety pin cover groove according to one embodiment of the disclosure.

Therefore, by using the safety pin cover 300, the modified safety in 310, and related parts, the only way to remove the modified safety pin 310 (including for the purpose of forcing the modified safety pin 310 out of the rifle 200 to disengage a magazine) is to remove the receiver cover, remove the bolt carrier assembly, depress the detent pin 302, and move the safety pin cover 300, thereby revealing the safety pin 310 as shown in FIG. 12. Because of the head 312 on the modified safety pin 310, the only way to force the modified safety pin 310 out of the rifle 200 is by using a tool to force the modified safety pin 310 out of the safety pin channel 220 through the area where the bolt carrier assembly would otherwise be located. Thus, in order to remove the modified safety pin (and thereby reload the rifle 200), it is necessary that the rifle 200 be substantially disassembled.

In addition to preventing easy access to the modified safety pin 310, another important reason for including the safety pin cover 300 is to prevent the modified safety pin 310 from migrating up out of the magazine safety pin channel 220 and into the operational path of the bolt carrier assembly during firing of the rifle 200.

Figure 13:
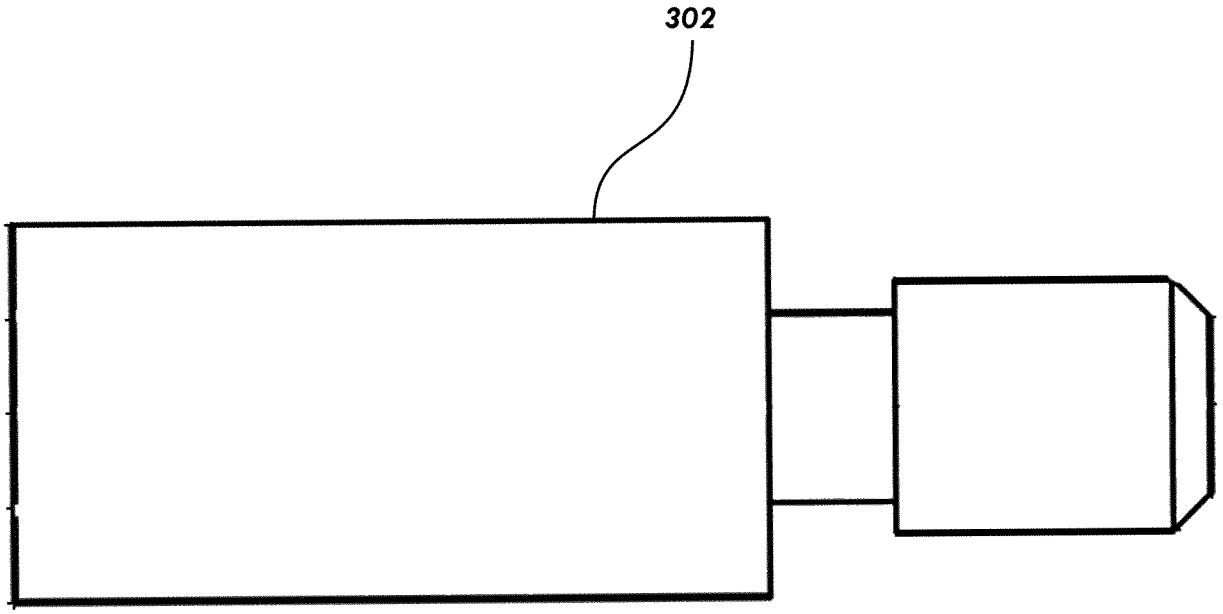
FIG. 13 shows a detailed drawing side view of an embodiment of a detent pin according to one embodiment of the disclosure.
Figure 14:
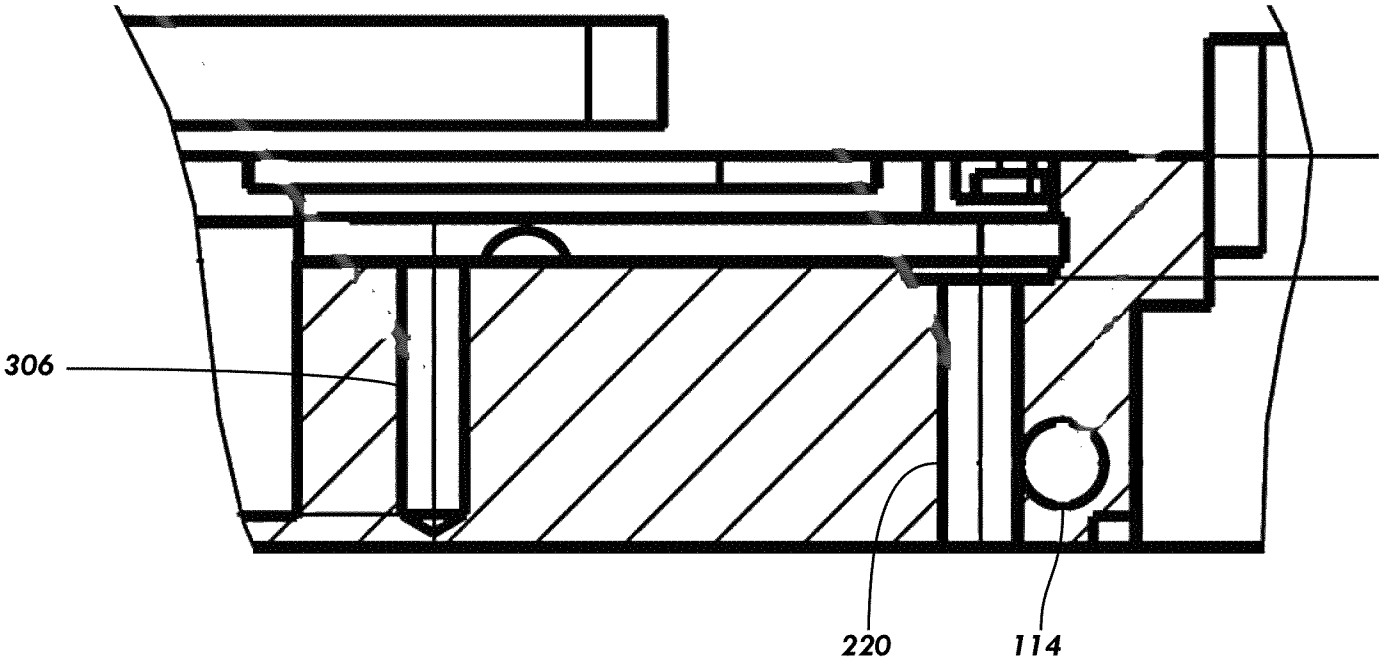
FIG. 14 shows a schematic cutaway side view of a portion of a rifle according to one embodiment of the disclosure.
Figure 15:
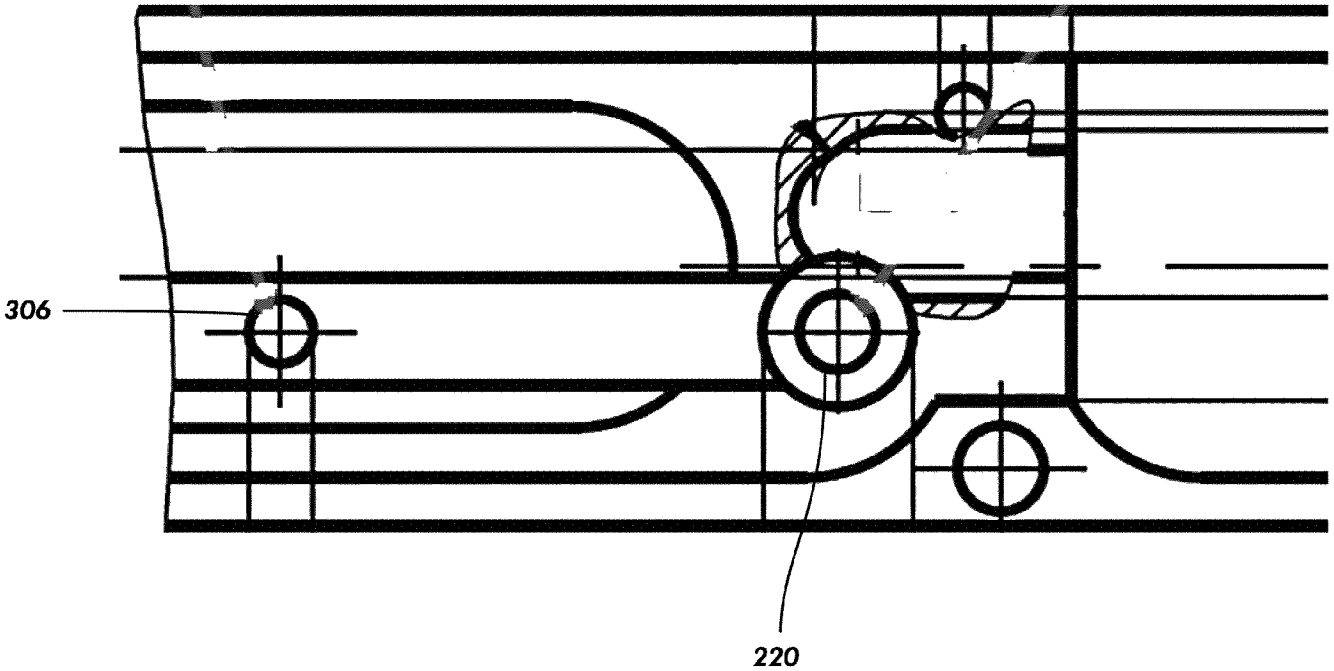
FIG. 15 shows a schematic cutaway top plan view of a portion of a rifle according to one embodiment of the disclosure.

Additional figures are provided to show examples of various parts described herein including FIG. 13 showing a detailed embodiment of the detent pin 302; FIG. 14 showing a cutaway side view of a Sa vzor 58 rifle including a detent pin channel 306; and FIG. 15 showing a cutaway plan of a portion of a Sa vzor 58 rifle including a detent pin channel.

The modified safety pin 310, the safety pin cover 300, and the detent pin 302 are each preferably made of metals or metal alloys such as, for example, steel, stainless steel, aluminum, titanium, iron, cobalt, nickel, copper, zinc, and mixed alloys thereof.

Figure 16:
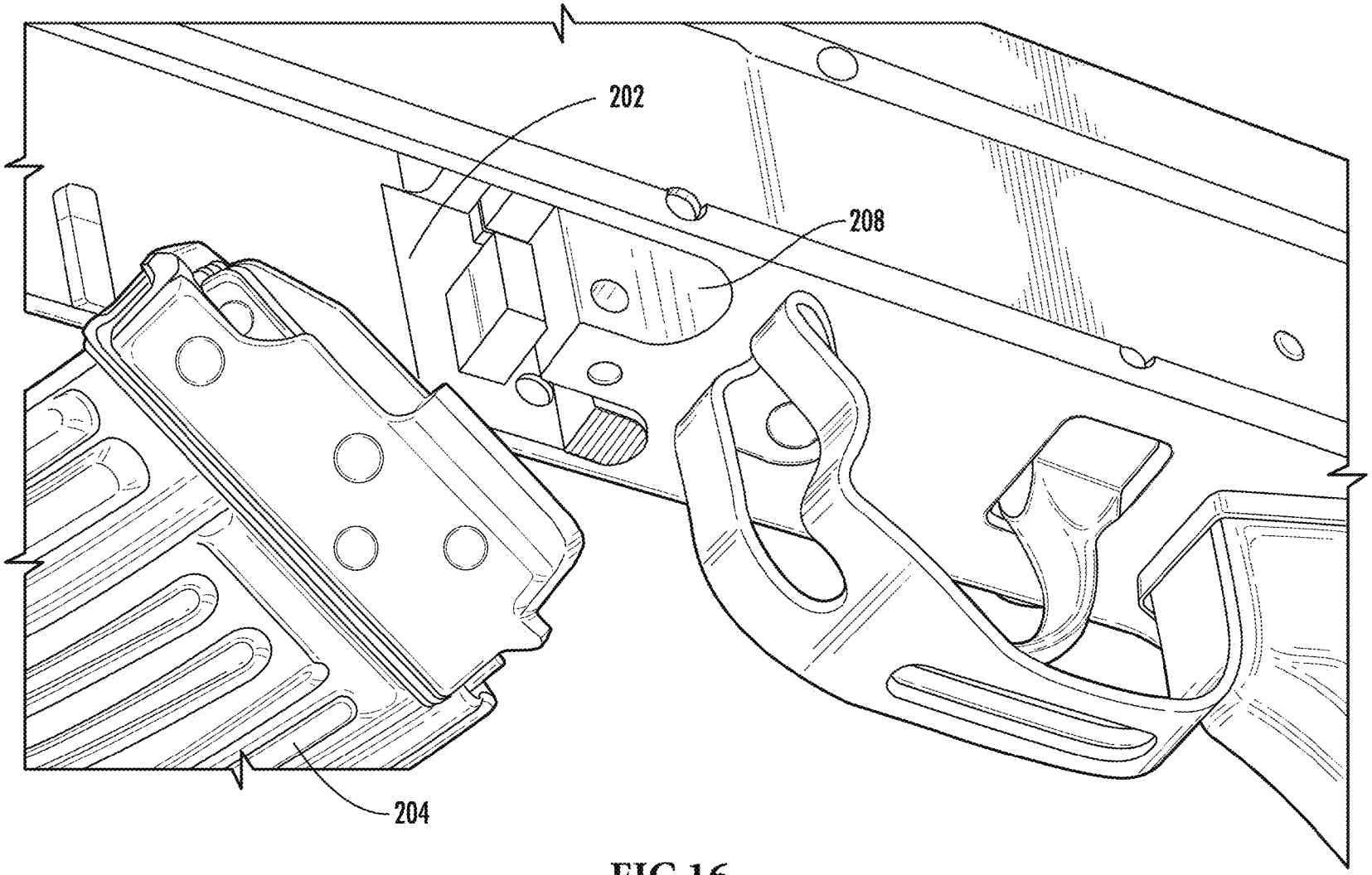
FIG. 16 shows a Sa vzor 58 rifle and a disengaged magazine clip according to one embodiment of the disclosure.
Figure 17:
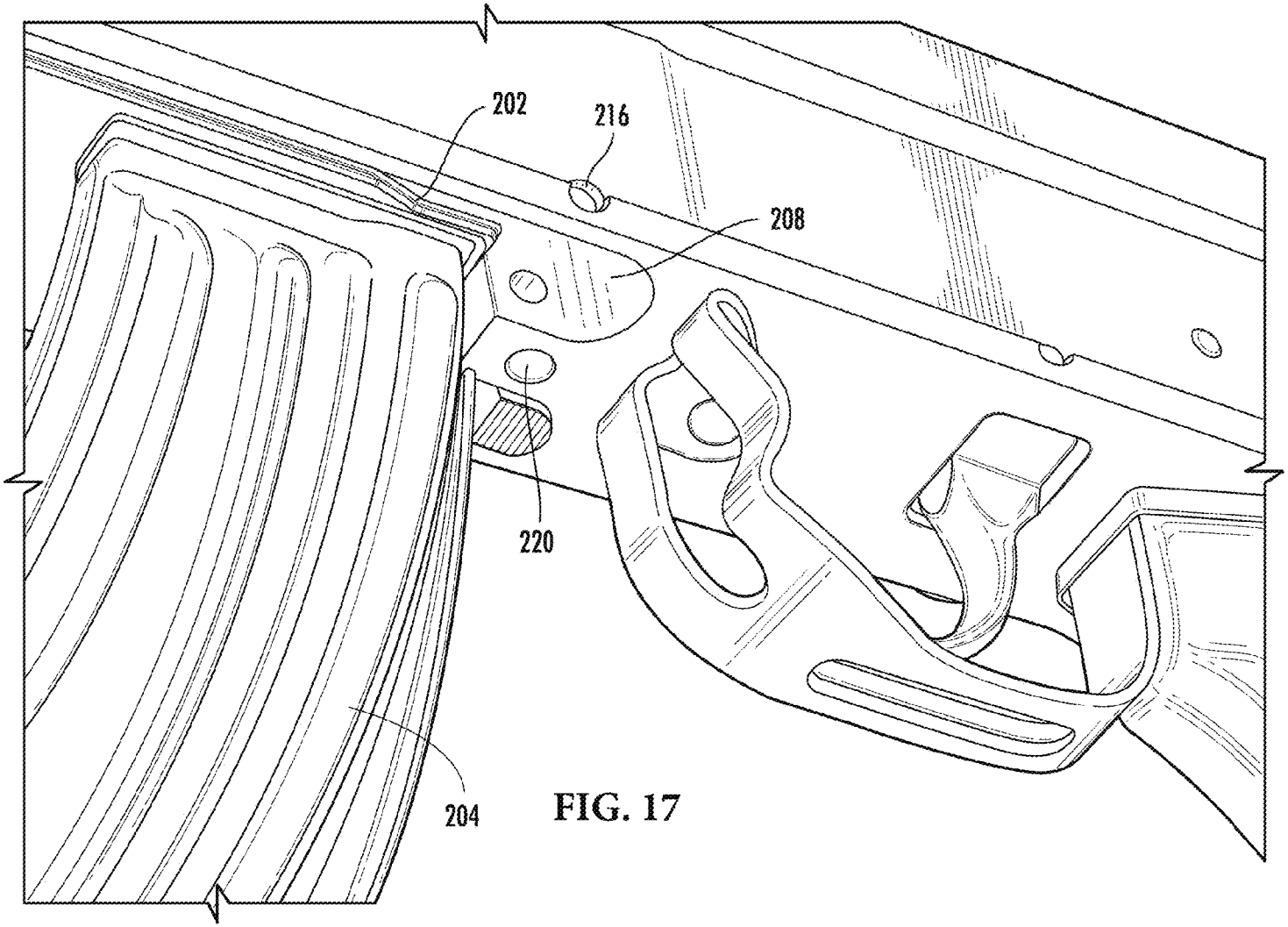
FIG. 17 shows a Sa vzor 58 rifle and a magazine clip placed in a magazine well of the rifle according to one embodiment of the disclosure.
Figure 18:
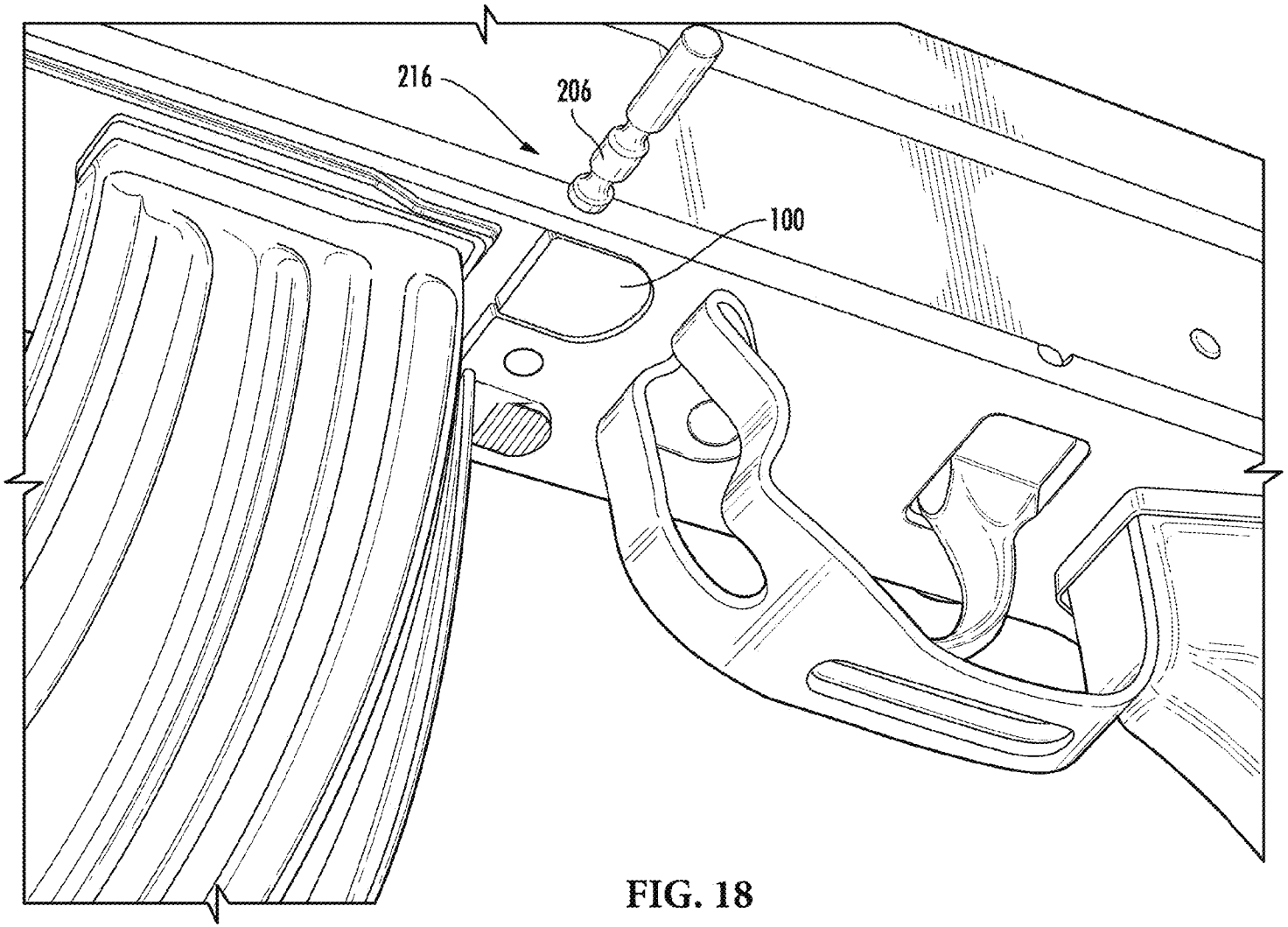
FIG. 18 shows a Sa vzor 58 rifle including a partially engaged block pin, a magazine block, and the tip of a modified safety pin according to one embodiment of the disclosure.
Figure 19:
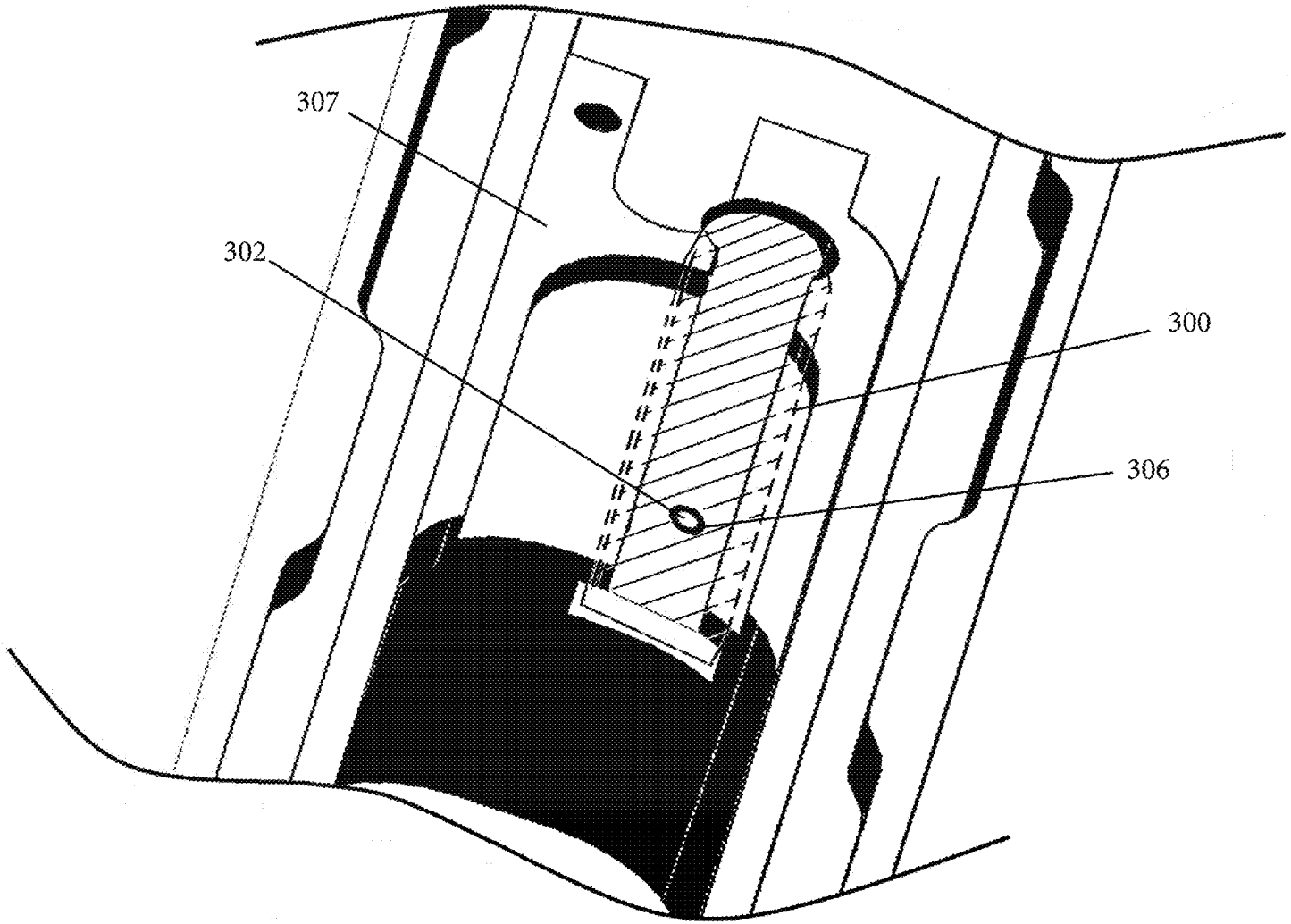
FIG. 19 shows a somewhat schematic view of a portion of a rifle including a modified receiver and a phantom view of a safety pin cover fully covering a safety pin channel according to one embodiment of the disclosure.

In addition to the various embodiments of apparatuses and kit combinations disclosed above, methods for assembling a modified Sa vzor 58 so that a magazine placed in a clipped position relative to the firearm cannot be detached from the firearm without first causing the firearm to become substantially disassembled. One embodiment includes the steps of (A) providing an Sa vzor 58 rifle (200) including the modified receiver 307 defining the magazine well 202, the groove 208 and safety pin cover groove 308, the safety pin cover 300, the cover detent pin 302 and the cover detent pin actuator 304; (B) placing the magazine 204 in a clipped position as shown in FIGS. 16-17; (C) inserting the magazine block 100 (or variation thereof) into the groove 208; (D) placing the magazine catch pin 206 through the first rifle catch pin aperture 216, into the passage 114 of the magazine block 100, and over to the second catch pin aperture 218 as shown in FIG. 18; (E) forcing the modified magazine safety pin 310 into the magazine safety pin channel 220 from an interior portion of the receiver (i.e., where the bolt carrier assembly is located during rifle firing); and (F) move the safety pin cover 300 along the safety pin cover groove 308 until the detent pin 302 engages the safety pin cover passageway 309 as shown in FIG. 13 and then FIG. 19.

A method for disassembling a modified Sa vzor 58 so that a magazine placed in a clipped position relative to the firearm cannot be detached from the firearm without first causing the firearm to become substantially disassembled including the steps as follows: (A) removing the bolt carrier assembly from a rifle including a modified receiver 307, a safety pin cover 300, and a modified safety pin; (B) moving the safety pin cover 300 to expose the modified safety pin 310; and (C) manipulating the modified safety pin 310 so that it is removed from a safety pin channel.

Figure 20:
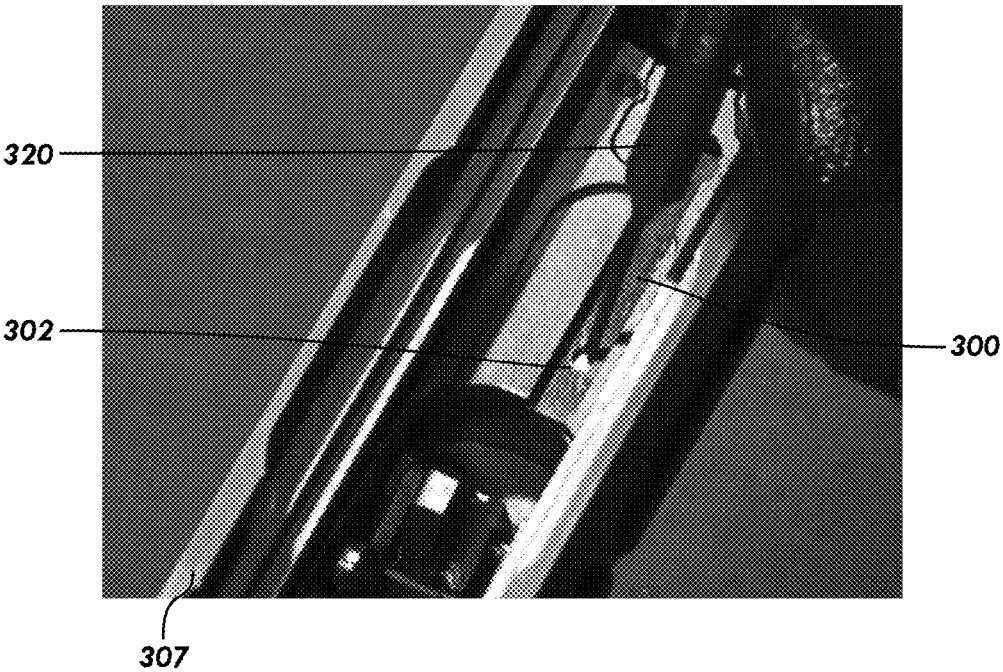
FIGS. 20-24 illustrate removal of a magazine from a firearm according to one embodiment of the disclosure.
Figure 21:
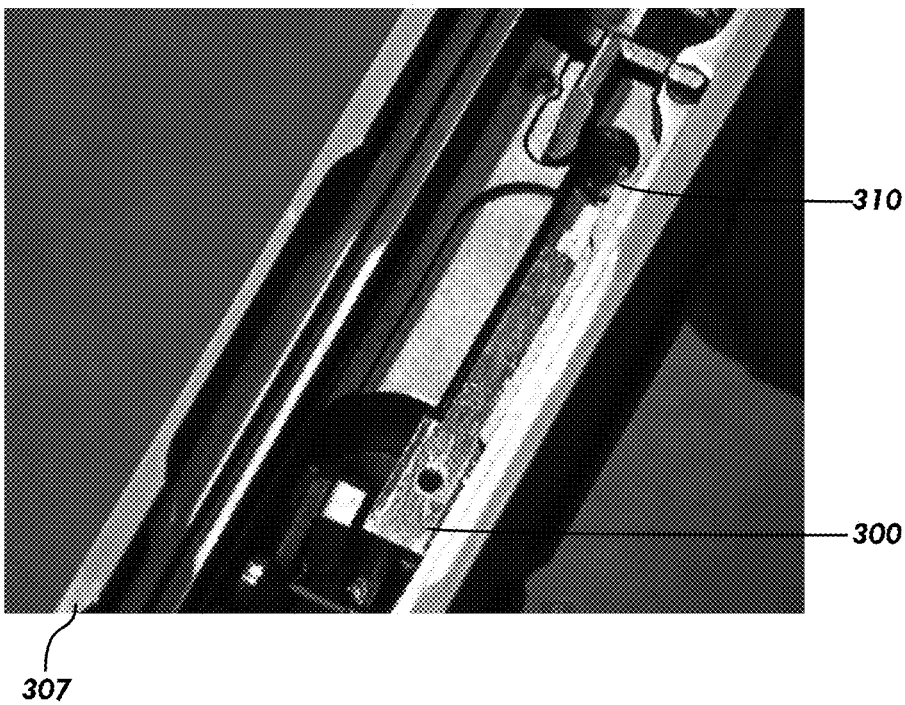

The apparatus and method of the present disclosure advantageously requires substantial disassembly of a firearm before a magazine of the firearm may be removed. FIGS. 20-24 illustrate an exemplary series of steps that illustrate substantial disassembly of a firearm for removal of the magazine. FIG. 20 is a top view of the modified receiver 307 with the bolt carrier assembly and receiver cover having already been removed. When installed, the bolt carrier assembly would substantially conceal the detent pin 302 shown in FIG. 20, thereby requiring that the bolt carrier assembly and receiver cover be removed before the detent pin 302 may be accessed. After removing the receiver cover and bolt carrier assembly, a tool 320 may be used to depress the detent pin 302 such that the detent pin 302 is urged into the detent pin channel 306, thereby allowing the safety pin cover 300 to be slidably adjusted along the safety pin cover groove 308 such that the head 312 of the modified safety pin 310 is exposed, as illustrated in FIG. 21.

The tool 320 may be formed of an elongate pointed object configured to engage the detent pin 302, safety pin 310, and magazine catch pin 206. The tool 320 may have a diameter that is equal to or less than a diameter of the safety pin cover passageway 309 to substantially allow the tool 320 to contact the detent pin 302 through the safety cover passageway 309.

Figure 22:
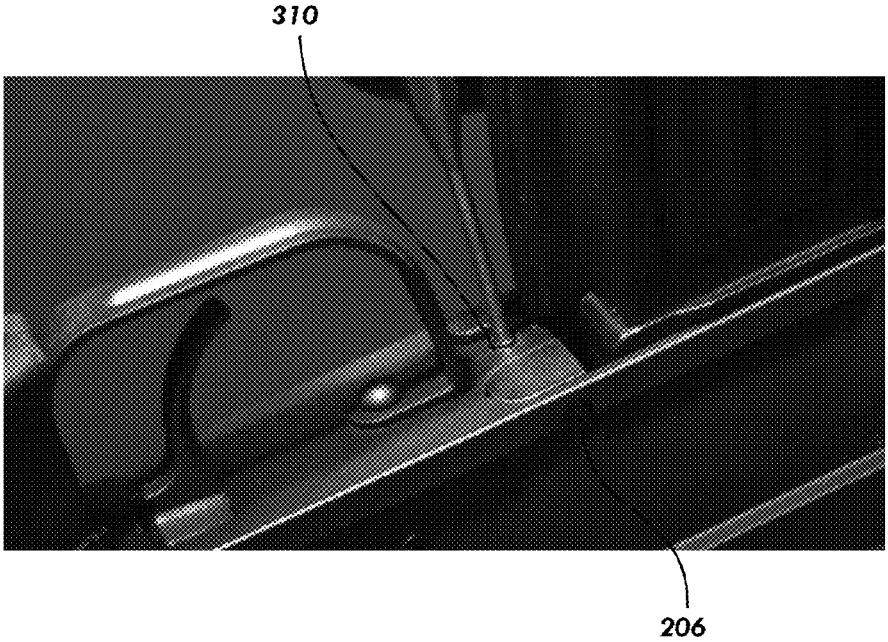

Referring now to FIG. 22, after revealing the head 312 of the modified safety pin 310, the tool 320 may be used to press the modified safety pin 310 such that the modified safety pin 310 is urged out of the safety pin channel 220 without interference from the safety pin cover 300. Because the head 312 of the safety pin 310 has a diameter that is greater than a diameter of the safety pin channel 320, the safety pin 310 may only be removed in a direction towards the safety pin cover 300.

Figure 23:
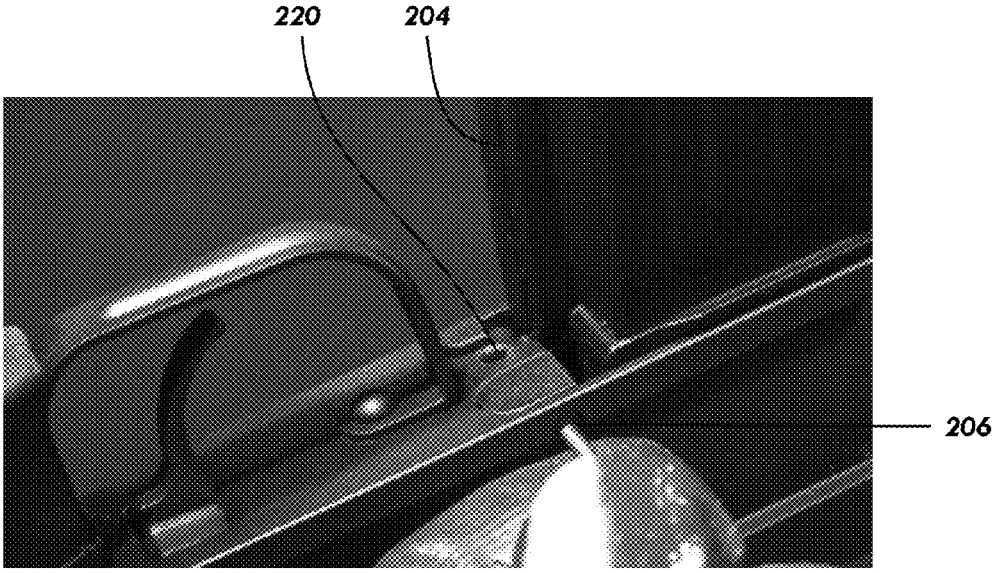
Figure 24:
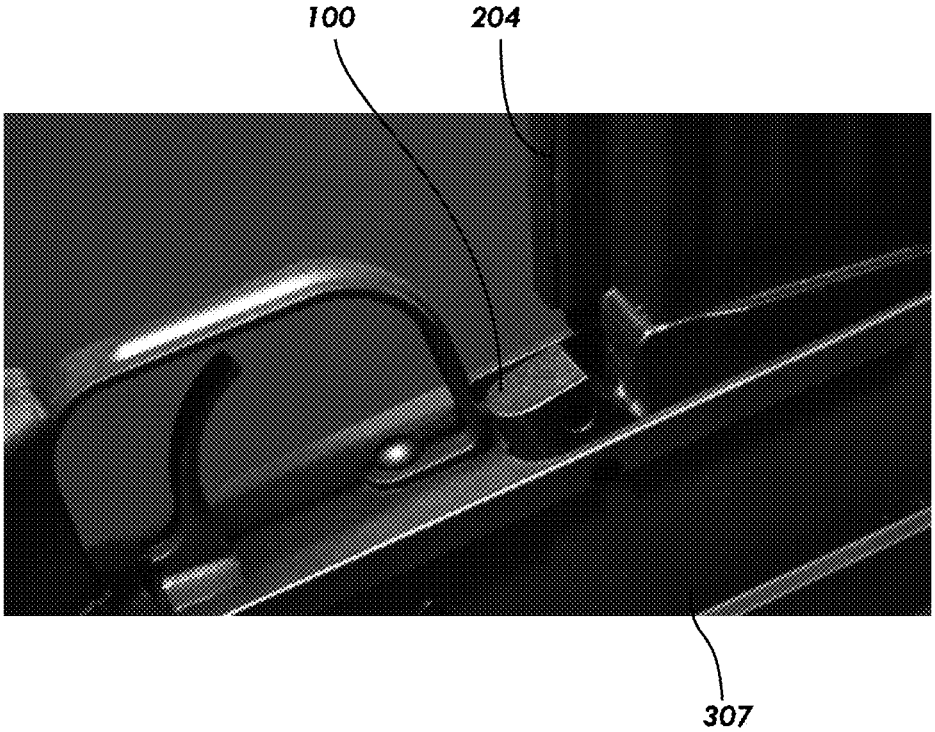

After the modified safety pin 310 is removed, the magazine catch pin 206 may be pressed out of the passage 114 by the tool 320, as shown in FIG. 23. Removal of the magazine catch pin 206 allows the magazine block 100 to be removed, thereby releasing the magazine 204 from the modified receiver 307.

Various embodiments described herein are used to effectively disable/modify the magazine quick release feature of Sa vzor 58 rifles and pistols so that such firearms may comply with various national and state laws in the United States.

The previously described embodiments of the present disclosure have many advantages, including providing a relatively inexpensive kit and/or apparatus and relatively simple methods to modify Sa vzor firearms. Many current technologies allow a user to use a hand tool to disengage a magazine from a firearm, but these technologies are at the very edge of the law in some jurisdictions and may be nonviable as gun laws fluctuate throughout the United States. Thus, the apparatuses, kits, and methods described herein provide a conservative and viable option to modify Sa vzor 58 firearms or otherwise use a modified Sa vzor 58 firearm with confidence that such use is within the limits of most if not all applicable gun laws in the United States related to firearms.

The foregoing description of preferred embodiments of the present disclosure has been presented for purposes of illustration and description. The described preferred embodiments are not intended to be exhaustive or to limit the scope of the disclosure to the precise form(s) disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the concepts revealed in the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

What is claimed is:

1. A magazine locking assembly configured to prevent removal of a magazine from a firearm having a receiver, a magazine secured within a magazine well of the receiver, and a bolt carrier assembly, the locking assembly comprising:

a magazine block assembly comprising a magazine block secured adjacent the magazine well of the firearm, wherein the magazine block prevents the magazine from being removed from the firearm without removal of the magazine block assembly;

a magazine safety pin for securing the magazine block assembly adjacent the magazine well of the firearm, the magazine safety pin including a safety pin head;

a safety pin cover movably attached to the firearm adjacent the bolt carrier assembly for concealing the safety pin head of the magazine safety pin, the safety pin cover including a safety pin cover passageway formed therethrough; and a cover detent pin configured to engage the safety pin cover passageway to prevent the safety pin cover from moving relative to the safety pin;

wherein when the magazine locking assembly and firearm are in an assembled configuration the safety pin cover conceals the safety pin head of the magazine safety pin and the bolt carrier assembly conceals the cover detent pin.

2. The magazine locking apparatus of claim 1, wherein the safety pin cover is slidably attached to the receiver of the firearm within a safety pin cover groove formed in the receiver.

3. The magazine locking apparatus of claim 2, wherein the cover detent pin is housed within a detent pin channel formed in the receiver of the firearm.

4. The magazine locking apparatus of claim 3 further comprising a detent pin actuator located in the detent pin channel for urging the detent pin out from the detent pin channel.

5. The magazine locking apparatus of claim 4, wherein the detent pin actuator comprises a spring.

6. The magazine locking apparatus of claim 1, wherein the magazine block assembly comprises a magazine block secured to the receiver with a magazine catch pin.

7. The magazine locking apparatus of claim 1, wherein the firearm comprises a Sa vzor 58 rifle.

8. A magazine locking assembly configured to prevent removal of a magazine from a firearm having a receiver, a magazine secured within a magazine well of the firearm, and a bolt carrier assembly, the locking assembly comprising:

a magazine block assembly comprising a magazine block secured adjacent the magazine well of the firearm, wherein the magazine block prevents the magazine from being removed from the firearm without removal of the magazine block assembly;

a magazine safety pin for securing the magazine block assembly adjacent the magazine well of the firearm, the magazine safety pin including a safety pin head;

a safety pin cover slidably attached to the firearm within a safety pin cover groove formed in the receiver adjacent the bolt carrier assembly for concealing the safety pin head of the magazine safety pin, the safety pin cover including a safety pin cover passageway formed therethrough;

a cover detent pin housed within a detent pin channel formed in the receiver, the cover detent pin configured to engage the safety pin cover passageway to prevent the safety pin cover from moving relative to the safety pin; and a detent pin actuator located in the detent pin channel for urging the detent pin out from the detent pin channel and into contact with the safety pin cover;

wherein when the magazine locking assembly and firearm are in an assembled configuration the safety pin cover conceals the safety pin head of the magazine safety pin and the bolt carrier assembly conceals the cover detent pin.

9. The firearm of claim 8, wherein the detent pin actuator comprises a spring.

* * * * *